United States Patent [19]

Ortloff et al.

[11] Patent Number: 4,604,961

[45] Date of Patent: Aug. 12, 1986

[54] VESSEL MOORING SYSTEM

[75] Inventors: John E. Ortloff; Allen P. Ziarnik; John J. Filson; John F. Gadbois, all of Houston, Tex.

[73] Assignee: Exxon Production Research Co., Houston, Tex.

[21] Appl. No.: 619,747

[22] Filed: Jun. 11, 1984

[51] Int. Cl.[4] ..... B63B 21/52

[52] U.S. Cl. ..... 114/230; 441/4; 441/5

[58] Field of Search ..... 114/230, 231, 312, 314; 441/2, 3, 4, 5; 166/350, 356

[56] References Cited

U.S. PATENT DOCUMENTS

| | | | |
|---|---|---|---|
| 2,699,321 | 1/1955 | Nelson | 255/2.5 |
| 3,279,404 | 10/1966 | Richardson | 114/5 |
| 3,525,312 | 8/1970 | Beck et al. | 114/5 |
| 3,605,668 | 9/1971 | Morgan | 114/5 |
| 3,860,983 | 1/1975 | Furth et al. | 9/8 |
| 3,902,447 | 9/1975 | Slocum | 114/230 |
| 3,947,907 | 4/1976 | Synodis | 9/8 |
| 3,978,810 | 9/1976 | Lucht et al. | 114/230 |
| 4,086,865 | 5/1978 | Statham | 114/230 |
| 4,321,720 | 3/1982 | Havre | 441/5 |
| 4,371,037 | 2/1983 | Arnaudeau | 166/366 |
| 4,490,121 | 12/1984 | Coppens | 114/230 |

*Primary Examiner*—Trygve M. Blix
*Assistant Examiner*—C. T. Bartz
*Attorney, Agent, or Firm*—Richard F. Phillips

[57] ABSTRACT

The disclosure describes apparatus for mooring a vessel 10 in unprotected waters. The vessel 10 contains a recess 34 in its hull adapted for receiving a buoyant mooring element 18. The mooring element 18 is attached to the ocean floor 12 by a plurality of mooring lines 20. Means are provided for releasably securing the mooring element 18 within the recess 34. The buoyancy of the mooring element is established such that on release from the vessel 10 it sinks to a predetermined depth a spaced distance above the ocean floor. The apparatus of the present invention is especially well suited for mooring a hydrocarbon storage tanker proximate the terminus of a production riser in waters subject to ice floes.

36 Claims, 10 Drawing Figures

VESSEL MOORING SYSTEM

FIELD OF THE INVENTION

This invention relates generally to systems for mooring vessels in unprotected waters. More particularly, this invention relates to a turret type mooring system suited for mooring a storage tanker proximate a production riser situated in waters subject to ice floes.

BACKGROUND OF THE INVENTION

In recent years increasing numbers of oil and gas fields have been developed in offshore areas. The oil and gas produced from such fields must be transported to shore either by pipeline or tanker. In utilizing tankers for this purpose, it is typical to produce the oil and gas through a riser extending from the seafloor to a surface loading facility from which produced hydrocarbons can be transferred to a waiting tanker. To avoid having to terminate hydrocarbon production when a transport tanker is not present to receive flow, it is common practice to locate a hydrocarbon storage unit at the surface loading facility. Most commonly, this storage unit is an unpowered, permanently moored storage tanker.

The use of storage tankers presents difficulties in regions where severe weather or ice floes occur. The forces exerted on the storage tanker mooring system by storm conditions or an ice floe can be quite severe, often many orders of magnitude greater than the forces present under ordinary conditions. Providing a mooring system capable of withstanding such extreme conditions poses a formidable technical challenge. Accordingly, most mooring systems adapted for arctic use provide some mechanism for releasing the vessel from the mooring system once environmental forces reach a predetermined level. Upon release, the vessel is allowed to drift until the adverse conditions abate, at which time it is returned to the mooring site and re-moored.

One of the earliest mooring systems based on this concept utilizes mooring lines extending from both the bow and stern of the storage tanker to anchors located at the ocean floor. The mooring lines are oriented such that the vessel is maintained on a fixed heading into the prevailing wind and waves and is situated above the riser. When environmental conditions become sufficiently severe, the mooring lines are buoyed off and the storage tanker moved. A disadvantage of this system, especially in the Arctic, is that the vessel cannot rotate to head into ice, wind and waves approaching abeam of its fixed heading. This forces the vessel to move off station in conditions which a ship able to alter its heading could weather.

To avoid the problems resulting from maintaining a vessel on a set heading, while retaining the ability to keep the vessel at a fixed location, turret mooring systems were developed. A typical turret mooring system is described in U.S. Pat. No. 3,605,668, issued Sept. 20, 1971. In this system the vessel is provided with a turret which is fixedly positioned relative to the ocean floor by a number of releasable mooring lines. The vessel weathervanes about the turret to assume the heading of least resistance to existing environmental conditions. Because the mooring lines enter the turret from a submerged location beneath the vessel, access to the points of mooring line attachment is awkward. To release the vessel it is necessary either to buoy-off and release each mooring line or to pull each mooring line into the vessel. This causes significant delays in releasing and re-mooring the vessel.

An alternative mooring system, known as the single point mooring system, utilizes a single surface buoy moored to the ocean floor. The storage tanker is moored to the buoy rather than directly to the ocean floor. A production riser extends from the ocean floor to a flowline swivel on the buoy. A loading hose extends between the swivel and the vessel. As the direction of the wind and waves changes, the vessel can weathervane about the buoy to maintain the heading of least resistance. The buoy to vessel attachment is above the ocean surface, simplifying release and reattachment. A disadvantage of the single point mooring system is that it is necessary to provide some means of preventing the tanker from overriding the surface buoy in high seas. The most widely practiced solution to this problem involves the use of a rigid mooring arm or yoke to maintain the vessel a fixed distance from the buoy. Further, the buoy, which remains at a fixed position at the surface even when the storage vessel has moved off, must be able to withstand any ice floes or other environmental conditions acting upon it. A typical single point mooring system is described in U.S. Pat. No. 4,371,037, issued Feb. 1, 1983.

In yet another type of mooring system, detailed in U.S. Pat. No. 4,321,720, issued Mar. 30, 1982, a buoyant mooring station is anchored to remain submerged a preselected distance beneath the ocean surface. To on-load produced hydrocarbons, a tanker positions itself above the mooring station and lowers a flowline. The flowline is coupled to the mooring station for transferring hydrocarbons to the tanker. The tanker remains on station through use of dynamic positioning. While this system substantially eliminates the action of storms, waves and ice floes on the mooring station, it is disadvantageous in that the tanker can take on produced hydrocarbons only in relatively calm conditions. Because this system can support only moderate forces acting on the tanker, it is not well suited for applications in which it is desirable to interrupt oil production as infrequently as possible.

It would be advantageous to provide a mooring system for use in the Arctic and other areas with adverse environmental conditions which could maintain a storage tanker on location in all but the most extreme of conditions. It would be further advantageous to provide a mechanism for allowing those components of the mooring system which remain permanently on site to avoid damage from the conditions which prompted the tanker to move off location. It would be further advantageous to avoid the need to individually reconnect each mooring line to the tanker when the tanker returns to the mooring station. It would be yet further advantageous to provide a mooring system from which the vessel could be released on short notice to avoid the rapid increase in loading due to changing sea ice conditions.

SUMMARY OF THE INVENTION

A vessel mooring system is set forth which is especially useful for mooring storage tankers in severe marine environments, such as the Arctic. The mooring system includes a buoyant mooring element which is adapted to be detachably locked to the vessel hull. A plurality of mooring lines extend from the ocean bottom to the mooring element. A turret is provided to permit the vessel to rotate relative to the mooring element about a vertical axis. The buoyancy of the mooring element is selected such that upon release from the vessel the load imposed by the mooring lines causes the mooring element to sink to a preselected depth. At this preselected depth, the decreased load on the mooring element, caused by the mooring lines resting in part on the ocean floor, is in static equilibrium with the buoyancy of the mooring element. Means are provided to return the mooring element to the vessel from its submerged position.

BRIEF DESCRIPTION OF THE DRAWINGS

For a better understanding of the present invention, reference may be had to the accompanying drawings, in which.

These drawings are not intended as a definition of the invention but are provided solely for the purpose of illustrating preferred embodiments of the invention, described below.

DESCRIPTION OF THE PREFERRED EMBODIMENTS

Figure 1:
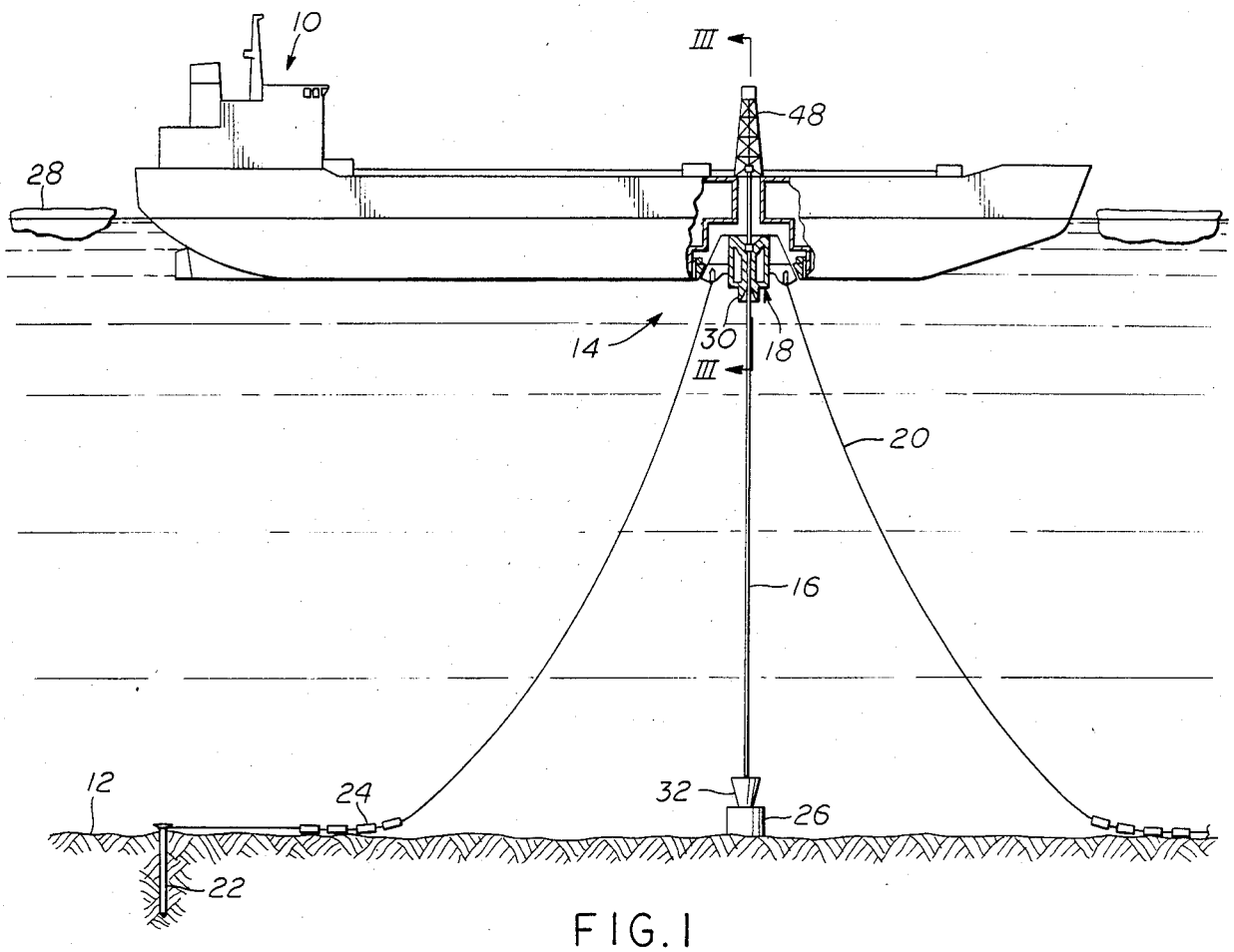
FIG. 1 is a side view of a storage tanker moored in an arctic environment with an embodiment of the present invention, a portion of the vessel hull and mooring element being cut away to show the interface between the mooring element and the vessel.

Illustrated in FIG. 1 is a preferred embodiment of the present invention. A vessel 10 is maintained at a selected location above the ocean floor 12 by a mooring system 14. FIG. 1 shows the vessel 10 to be a tanker used to store hydrocarbons produced through a riser 16 from a subsea wellhead or pipeline terminus 26 situated in an environment subject to ice floes 28. However, those skilled in the art will recognize from the following discussion that the mooring system 14 has a broad range of applications in the field of mooring floating vessels and structures and is not limited to use solely in arctic environments or oil and gas producing operations. To the extent that the following description is specific to floating storage of hydrocarbons in an arctic environment, this is by way of illustration rather than limitation.

The mooring system 14 includes a buoyant mooring element 18 adapted to be secured within the vessel 10, a plurality of catenary mooring lines 20 extending from the mooring element 18 to the ocean floor 12, one or more anchor piles 22 securing each mooring line 20 to the ocean floor 12, and a plurality of clump weights 24 secured to each mooring line 20 at a position proximate the corresponding pile 22. The clump weights 24 serve to resist horizontal displacement of the mooring element 18 away from its equilibrium position. As environmental forces acting on the vessel 10 cause it to displace the mooring element 18 away from a central location relative the mooring lines 20, the mooring lines 20 extending in a direction away from the travel of the mooring element 18 are placed in increased tension, lifting the clump weights 24 attached to those mooring lines 20 off the ocean floor 12. The load imposed by the elevated clump weights 24 tends to urge the mooring element 18 and vessel 10 back to a central position. Preferably, the mooring lines 20 are bridge strand. However, wire rope or chain could also be utilized.

The ocean floor connection points for the mooring lines 20 are arranged in a circular array centered about the base of the riser 16. Preferably, twenty-four equiangularly spaced mooring lines are utilized. The length of the mooring lines 20 from the clump weights 24 to the mooring element 18 is preferably in the range of 5 to 20 times the water depth. However, the number, orientation and configuration of the mooring lines 20 will depend on numerous factors, including current, wave and wind conditions, water depth, vessel size, and the nature of ice floes present at the mooring site. It should be noted that in FIGS. 1 and 2 the lateral extent of the mooring lines 20 has been greatly compressed to permit the ocean floor connection points to be represented on the same sheet with the vessel 10.

Figure 2:
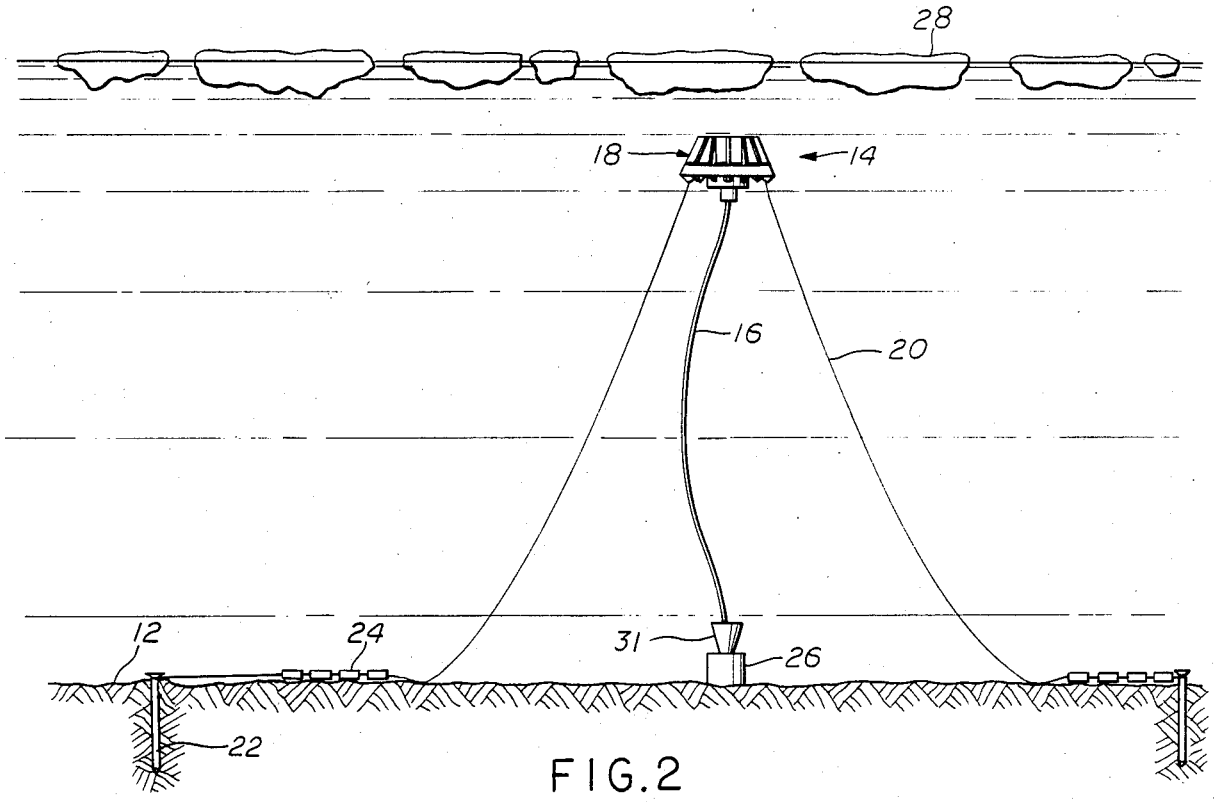
FIG. 2 is a side view of the mooring element after it has been disconnected from the vessel in response to the presence of an ice floe, for the purpose of clarity only two mooring lines are shown.

The oil and gas are transmitted to the buoyant mooring element 18 through a flexible riser 16. The riser 16 is sufficiently compliant to permit the buoyant mooring element 18 to be submerged a distance beneath the ocean surface without buckling or otherwise damaging the riser 16. This can be achieved through the use of flexible riser conduit, as illustrated in FIG. 2. Alternatively, rigid riser conduit provided with articulated joints could be utilized. Riser bend-limiting supports 30,31 are provided at the riser-mooring element interface and also at the riser-wellhead interface. The bend-limiting supports 30,31 prevent damage to the riser 16 at these high stress locations. The bend-limiting supports 30,31 can be eliminated if articulated riser joints are provided proximate the ends of the riser 16.

The buoyancy of the mooring element 18 is established such that after release from the vessel 10 it will sink to and remain at a preselected depth. Upon release from the vessel 10, the mooring element 18 sinks under the initial load of the mooring lines 20, riser 16 and elevated portions of the clump weights 24. As the mooring element 18 submerges, the clump weights 24 and increasing amounts of each mooring line 20 come to rest on the ocean floor 12, decreasing the load on the mooring element 18. The buoyancy of the mooring element 18 is selected to just equal the water weight of that portion of the mooring lines 20 and other elements supported by the mooring element 18 at the desired equilibrium depth. The equilibrium depth should be deeper than the maximum keel depth of the tanker 10 and other vessels traversing the location of the mooring system 14. The equilibrium depth should also be deeper than the draft of ice floes anticipated for the mooring location. However, to simplify mooring element retrieval, to avoid imposing unnecessarily great bending loads on the riser 16, and to prevent kinking of the mooring lines 20, it is desirable that the equilibrium depth be no greater than is required to ensure that the submerged mooring system 14 is not struck by a vessel or extreme ice features. For most applications, an equilibrium depth between 15 and 25 meters below the ocean surface is desirable. At the time of fabrication the mooring element 18 is provided with a slight excess of buoyancy. During installation, fixed ballast is added to the mooring element 18 to provide the precise buoyancy required to yield the desired equilibrium depth.

Figure 3:
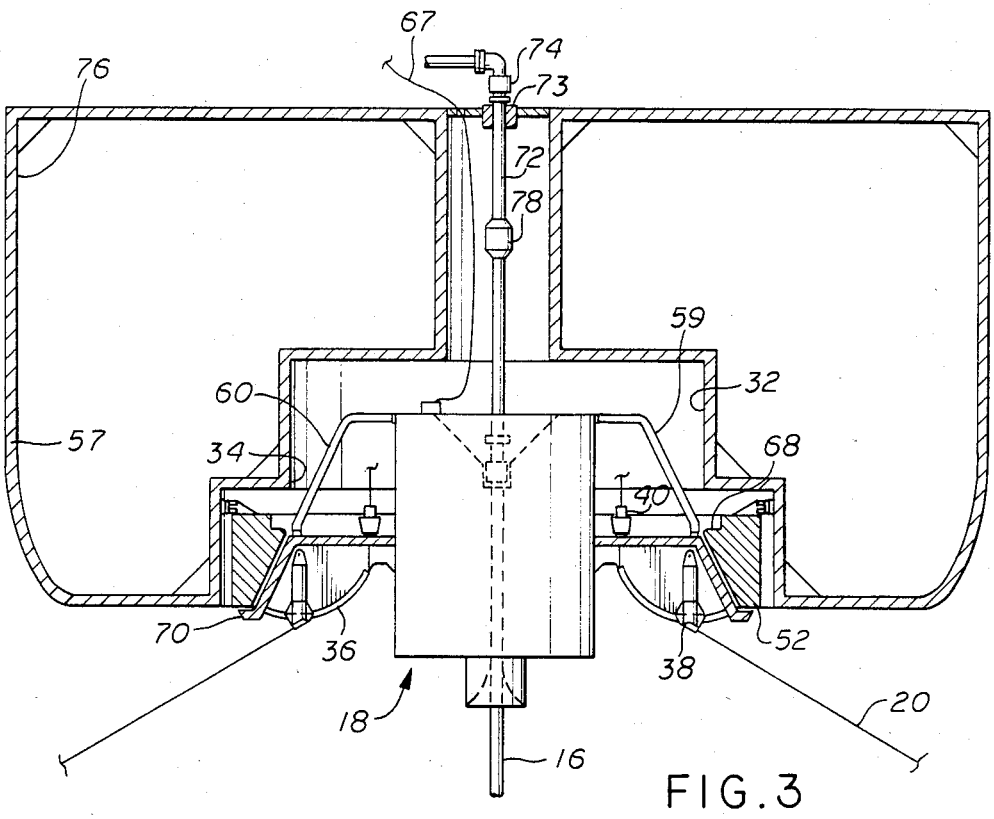
FIG. 3 is a cross section taken through the vessel hull along line III—III of FIG. 1, the mooring element and associated fluid conduits are shown in elevation, this view represents the vessel during hydrocarbon onloading, for the purpose of clarity the hoisting rig is deleted and only two sets of fairleads and mooring lines are shown.

Illustrated in FIG. 3 is a cross section taken through the vessel 10 along line III—III of FIG. 1. The vessel 10 is provided with a moonpool 32. The lower portion of the moonpool 32 defines a mooring recess 34. Means are provided for securing the vessel 10 to the mooring element 18 at a location within the mooring recess 34. Preferably, the mooring recess 34 is fitted with a revolving turret 52 into which the mooring element 18 is received.

The mooring element 18 includes a plurality of radially spaced fairleads 36 for orienting the mooring lines 20 in the proper direction and for limiting the radius of curvature of the mooring lines 20. Each fairlead 36 is provided with a pivoting guide element 38 which prevents the mooring line 20 from jumping laterally out of the fairlead 36 should the mooring element 18 rotate a few degrees relative to the orientation of the mooring line 18. An adjustable wire clamp 40 is provided to secure each mooring line 20 to the mooring element 18.

Figure 6:
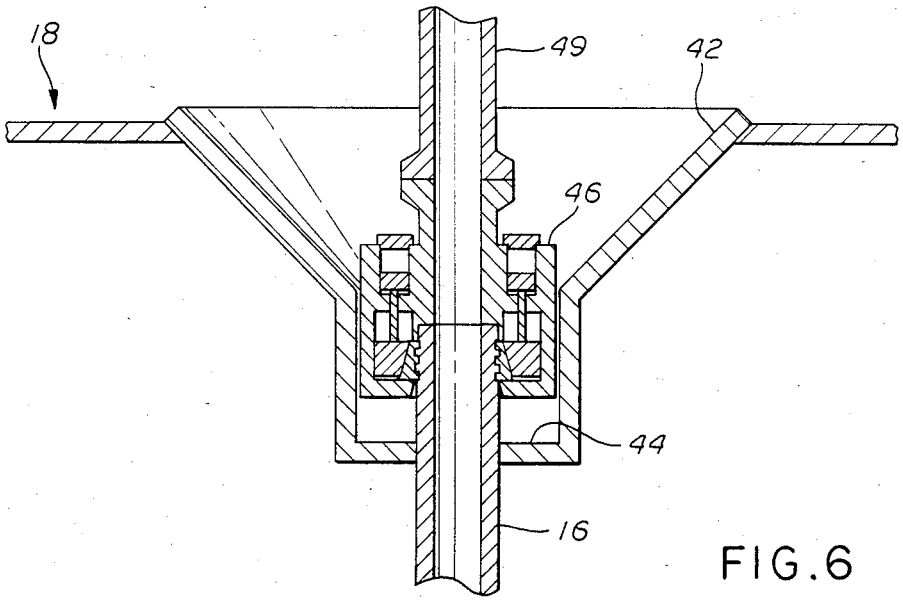
FIG. 6 is a detailed side view, in cross section, of the upper portion of the mooring element showing the retrieval connector coupled in place.

The mooring element 18 is adapted to be remotely retrieved by the vessel 10. The vessel 10 is provided with a hoisting rig 48 (FIG. 1) for lowering a mooring element retrieval string 49 downward through the moonpool 32 to the mooring element 18. Affixed to the end of the retrieval string 49 is a retrieval connector 46 adapted to grasp the mooring element 18. The hoisting rig 48 is then used to pull the mooring element 18 upward into the mooring recess 34. As best shown in FIG. 6, the upper surface of the mooring element 18 is provided with a conical centering recess 42. Situated at the bottom of the centering recess 42 is a receiving port 44 into which the retrieval connector 46 is received and secured. Preferably, the receiving port 44 and retrieval connector 46 establish a bayonnet or other spear-type connection such that by positioning the retrieval connector 46 within the center recess 42 and forcing it downward, the retrieval connector 46 will automatically engage the receiving port 44. The lower end of the retrieval string 49 can be provided with a sonar transducer and subsea television unit (not shown) to assist in positioning the retrieval connector 46 within the centering recess 42.

A plurality of buoyancy chambers 50 are symmetrically positioned about the riser axis to form the central structure of the mooring element 18. A deck 51 extends radially outward from a central portion of the mooring element 18 to a position radially outward from the buoyancy chambers 50. The deck 51 provides a foundation for the fairleads 36 and much of the other equipment incorporated into the mooring element 18. The deck 51 terminates at the upper boundary of a frustoconical skirt 61 which serves to center the mooring element 18 within the turret 52 and to protect the fairleads 36 from damage in the course of securing and releasing the mooring element 18. Extending from the upper boundary of the skirt 61 to the upper portion of the buoyancy chambers 50 is a centering cage 60. The centering cage 60 is formed of a plurality of sacrificial, impact absorbing struts. The centering cage 60 serves to prevent damage to the vessel 10 and to the equipment situated on the mooring element deck 51 in the process of releasing and retrieving the mooring element 18. Replacement struts are carried aboard the vessel 10 should the centering cage 60 be damaged in the course of mooring element retrieval or release. The buoyancy chambers 50 and other components of the mooring element 18 are symmetrically positioned about the central axis of the mooring element. This serves to maintain the upper portion of the mooring element, in which the receiving port 44 is situated, in an upward facing position upon release and submergence of the mooring element 18. This greatly facilitates recapturing the mooring element with the retrieval string 49 and also assists in preventing kinking or other damage to the mooring lines 20.

A turret 52 is situated at the lower periphery of the vessel mooring recess 34. A number of bearings 54 support the turret 52 on a circular bearing race 56 affixed to the hull 57 of the vessel 10. The turret 52 is adapted to rotate relative to the vessel 10 about a vertical axis. The inner face 58 of the turret 52 is frustoconical, serving to guide the buoyant mooring element 18, which has a mating frustoconical outer surface 59 defined by the skirt 61 and centering cage 60, into concentric alignment with the turret 52.

The mooring element 18 is secured within the turret 52 by a plurality of hydraulically actuated securing pins 62 situated on the mooring element 18. These securing pins 62 are cantilevered from pin support housings 64. Actuation of each securing pin 62 is controlled by a double acting hydraulic cylinder 66. The control lines (not shown) of each of the hydraulic cylinders 66 are connected in parallel to allow simultaneous operation of the pins 62. The control system (not shown) for the hydraulic cylinders 66 is located onboard the vessel 10. A diver-connectable umbilical 67 is provided for connecting the control system to the hydraulic cylinders 66.

Figure 4:
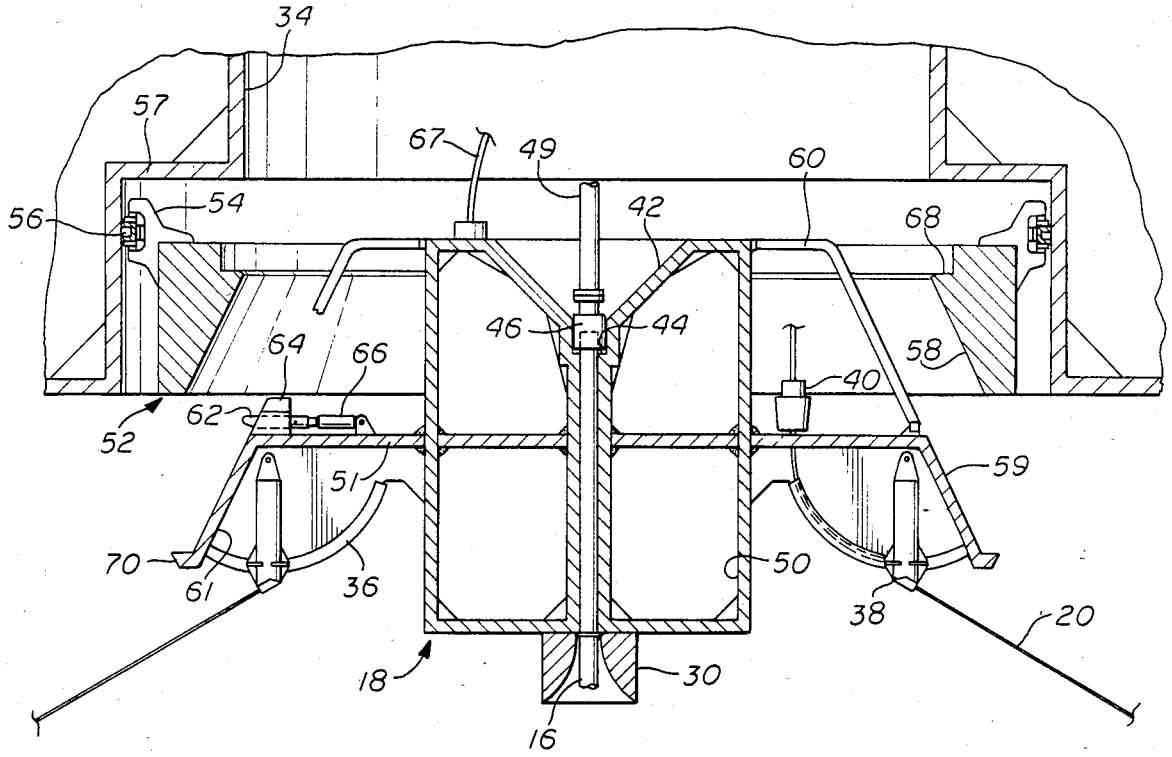
FIG. 4 is a view of the mooring element, the mooring element locking system, turret retrieval string when the mooring element is being pulled into the mooring recess, to better illustrate the securing pin and associated elements a portion of the centering cage has been deleted.

During the time the mooring element 18 is being hoisted into the vessel mooring recess 34, the securing pins 62 are retracted. Once the mooring element 18 is within the mooring recess 34, a diver connects the hydraulic umbilical 67 to the mooring element 18. Next, the mooring element 18 is hoisted high enough that a circumferential skirt flange 70 of the mooring element skirt 61 comes into full contact with the bottom of the turret 52. The securing pins 62 are then extended. As best shown in FIG. 4, the securing pins 62 and the pin bearing surface 68 upon which they rest define an inclined interface which provides a wedging action upon activation of the securing pins 62. This wedging action, acting against the lower interface between the mooring element skirt flange 70 and the turret 52, imposes a preload which prevents any relative motion between the mooring element 18 and turret 52 once the upward force applied by the retrieval string 49 is removed. It should be noted that no special rotational alignment between the mooring element 18 and turret 52 is necessary. The securing pins 62 can be seated on any portion of the pin bearing surface 68. This greatly simplifies reconnection of the mooring element 18 to the vessel 10.

Figure 5:
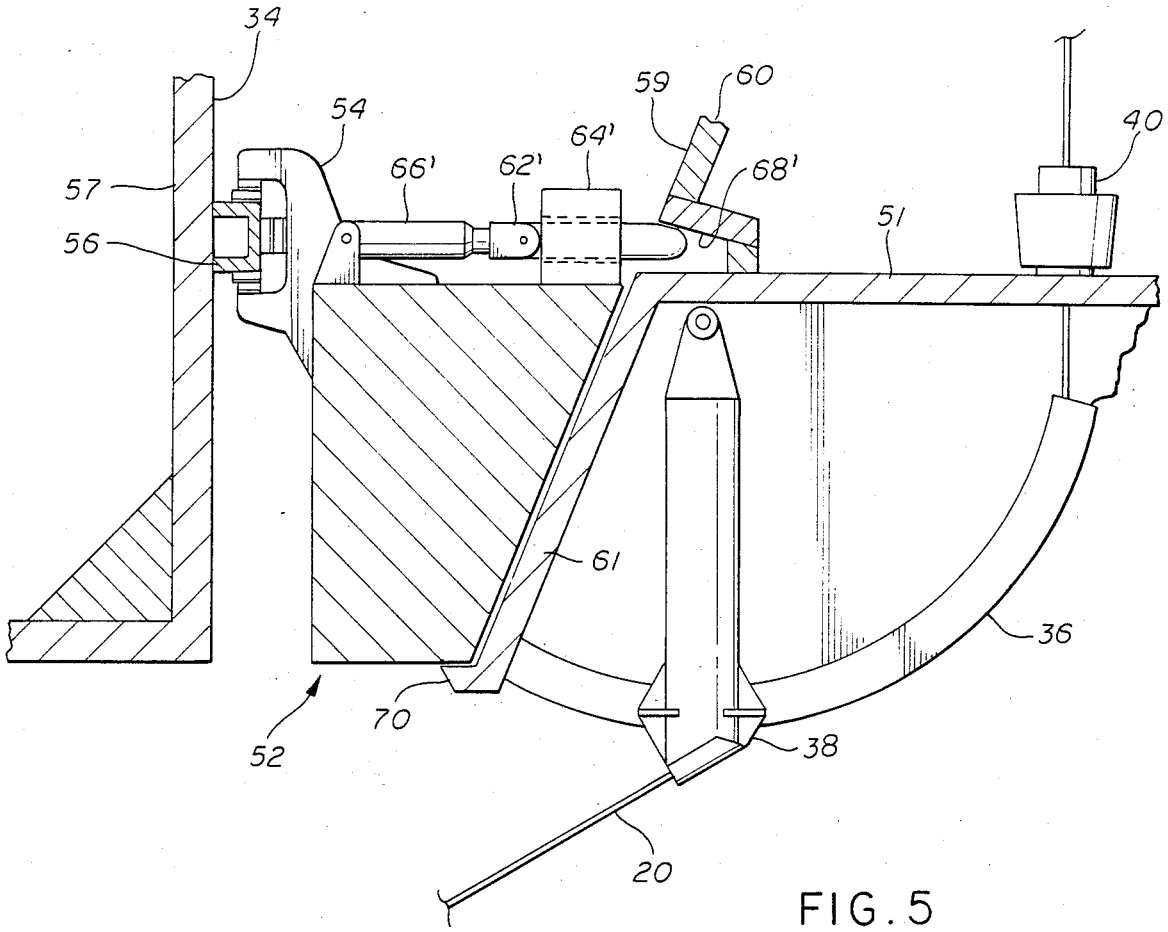
FIG. 5 is a side view of a portion of the interface between the turret and mooring element, this view illustrates an alternative embodiment of the interface shown in FIGS. 3 and 4.

Shown in FIG. 5 is an alternative to the mooring element securing system described above and depicted in FIGURES 3 and 4. In this alternative, the securing pins 62' and associated support and actuation elements are situated on the turret 52. The mooring element 18 is provided with a pin bearing surface 68' adapted to rest upon the extended securing pins 62'.

Once the mooring element 18 is locked within the turret 52, the retrieval string 49 is removed, stowed and replaced with a production swivel string 72 for receiving flow from the riser 16. As will be described in greater detail below, the production swivel string 72 is designed to support the full downward load imposed on the vessel 10 by the mooring system 14. The hoisting rig 48 is used to place the production swivel string 72 in tension after connection. Tension is maintained by a suitable clamping element 73 positioned proximate the upper deck of the vessel 10. The production swivel string 72 is provided with a swivel 74 to accomodate the rotation of the vessel 10 relative to the riser 16. From the swivel 74 the production flow is pumped into the receiving tanks 76 of the vessel 10.

There are two modes of mooring element release. The standard method of release involves the following steps: production flow is terminated; the production swivel string 72 is released from the connection receiving port 44 and stowed; the retrieval string 49 is connected to the mooring element 18; an upward force is applied through the retrieval string 49 to lessen or remove the load on the securing pins 62; the securing pins 62 are retracted; the umbilical 67 is detached; and the hoisting rig 48 then lowers the mooring element 18 to a position beneath the mooring recess 34, following which it is released by disengaging the retrieval connector 46. The mooring element 18 then sinks to its equilibrium depth where it will remain until retrieval.

In rapid release, production flow is terminated, the hoisting rig 48 transfers the downward load of the mooring element 18 to the production swivel string 72, the securing pins 62 are retracted and a hydraulically actuated emergency release connector 78 in the production swivel string 72 is triggered causing the mooring element 18 to drop free of the vessel 10. Those portions of the production swivel string 72 and hydraulic control umbilical 67 which remain attached to the mooring element 18 would be removed by divers prior to subsequent retrieval of the mooring element 18. Spares would be carried on the vessel 10 to replace these components. The conical interface between the vessel 10 and mooring element 18 prevents the mooring element 18 from becoming lodged within the mooring recess 34 should environmental forces impose a skewing action during rapid release.

Numerous advantages accrue from use of a bottom mounted, releasable mooring system. Because the mooring element 18 is positioned within the vessel 10, it need not be designed to withstand the action of the ice floes that act on mooring systems having elements exposed at the ocean surface. Metallurgical problems are greatly simplified in that, being submerged, the mooring element 18 is not exposed to temperatures colder than about −3° C. In contrast, portions of surface mooring systems used in arctic conditions must often survive temperatures as low at −50° C. Also, because the interface between the mooring element 18 and the vessel 10 is submerged beneath the ocean surface, there will be no ice buildup to impede connection of the mooring element 18 to the vessel 10. Further, because the point at which the mooring element enters the vessel 10 is 10–15 meters below the ocean surface, wave action is much less a problem than is present in docking with a surface mooring system. This feature of the present invention is especially advantageous in the final stages of reconnection, when the mooring element 18 is entirely within the mooring recess 34 and substantially free from all wave-induced forces. The vessel 10 is benefitted from use of a bottom mounted design in that no alteration of the ice-resisting surfaces of the vessel is required. Further, it is not necessary that the vessel 10 have any specific angular orientation relative to the mooring element 18 in reconnection.

Figure 7:
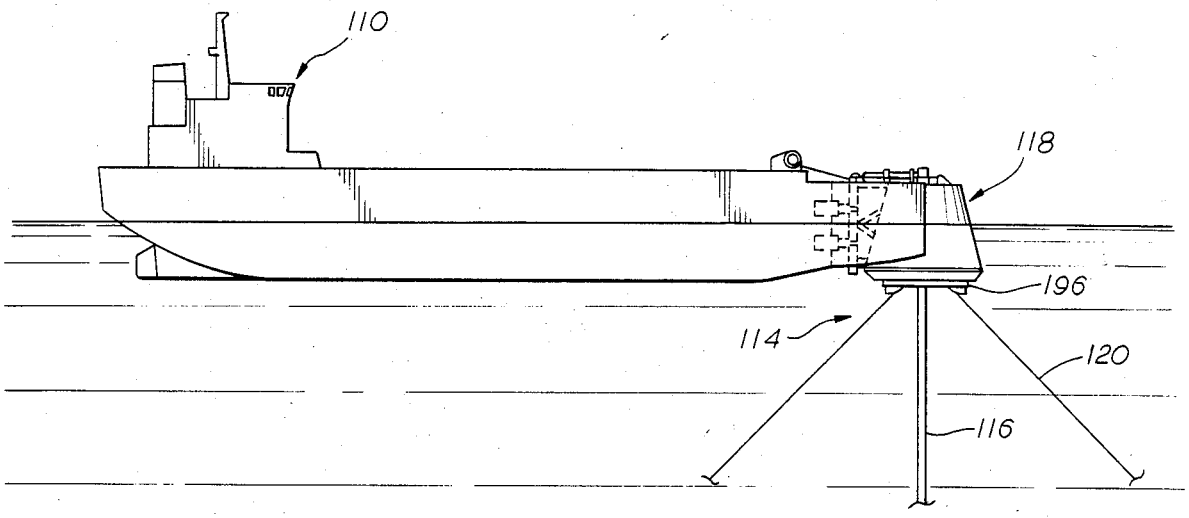
FIG. 7 is a side view of a storage tanker moored in place with an alternative embodiment of the present invention.
Figure 8:
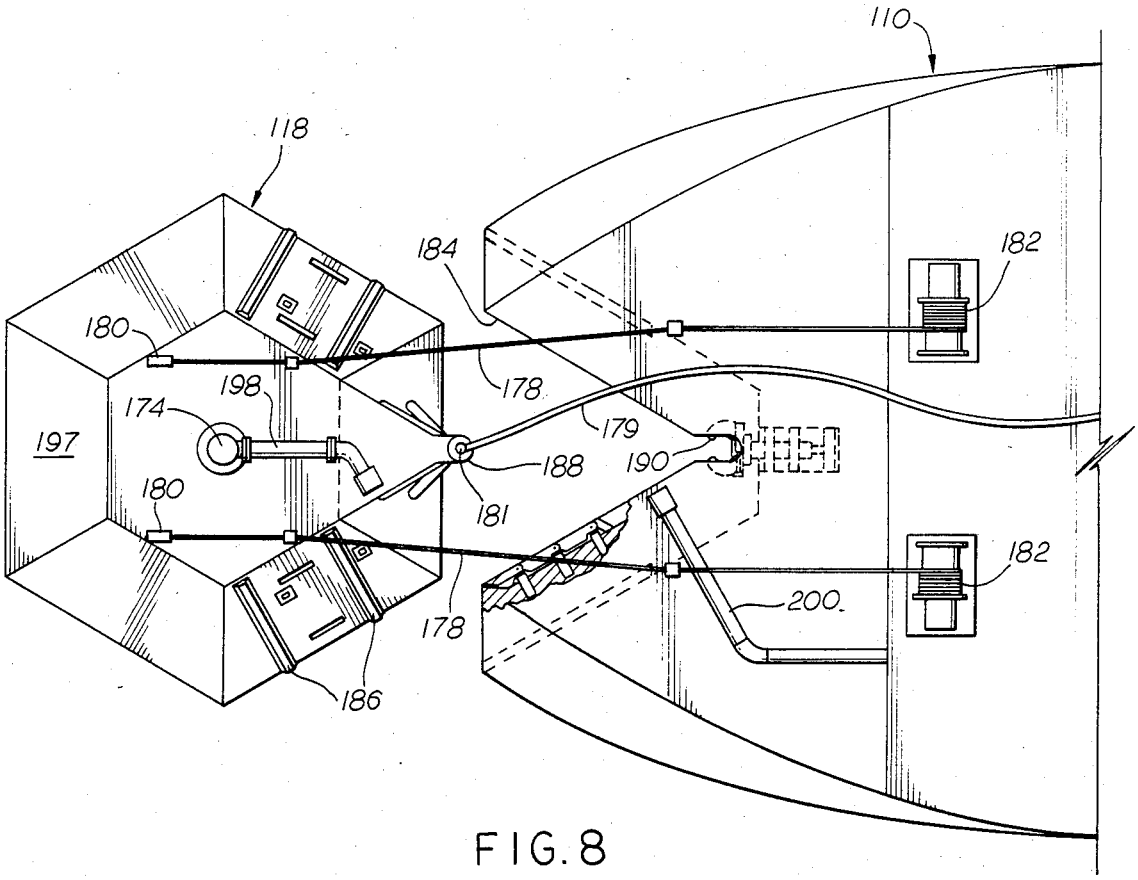
FIG. 8 is a detailed top view of the mooring buoy and storage tanker bow illustrated in FIG. 7 with the buoy in the process of being reconnected to the storage tanker.
Figure 9:
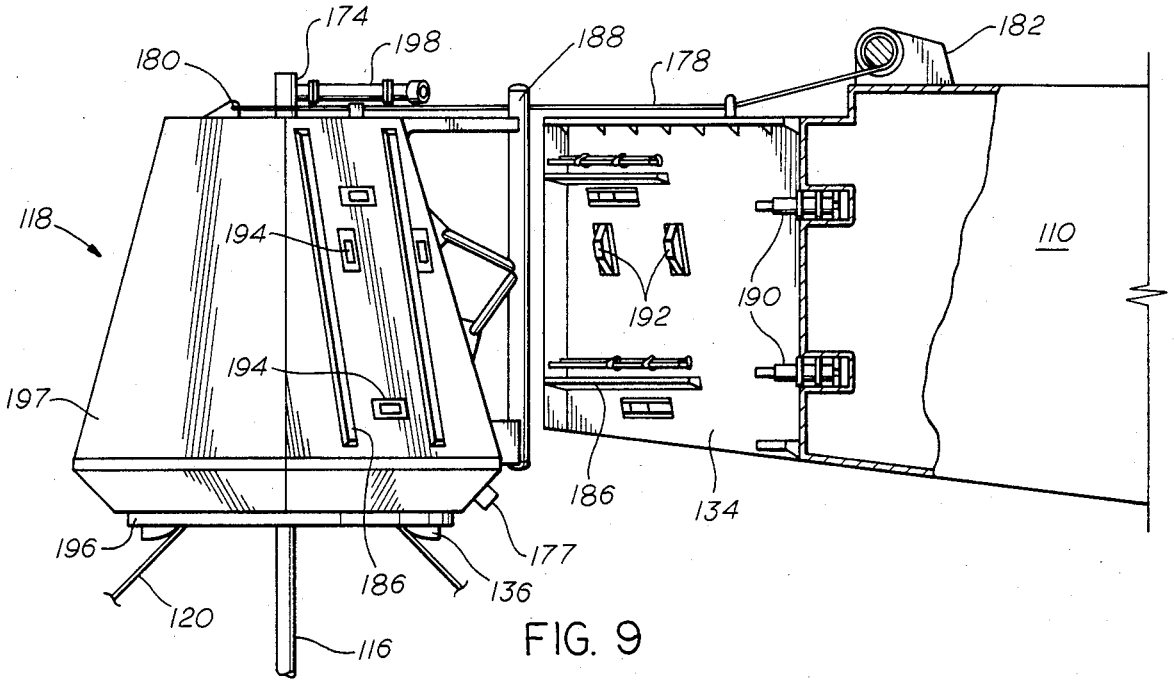
FIG. 9 is a side view corresponding to FIG. 8, in the interest of clarity the fore section of the storage tanker is cut away and only two fairleads are shown; and, FIG. 10 is a top view of a docking arm adapted for use in conjunction with the mooring buoy and storage tanker illustrated in FIGS. 7–9.

Shown in FIG. 7 is an alternative embodiment of the present invention. In this embodiment, the mooring element 118 is connected to a forward, surface location of the vessel 110 rather than a submerged location, as is the case in the previously described embodiment. As best shown in FIGS. 8 and 9, the outer surface of the mooring element 118 defines a truncated hexagonal pyramid. Other shapes could also be used, however it is desirable that the mooring element 118 be substantially symmetric about a vertical axis. The bow of the vessel 110 defines a forward mooring recess 184 adapted to receive the aft half of the mooring element 118. The forward half of the mooring element 118 projects from the vessel front to define the bow of the vessel 110. The front of the mooring element 118 is stiffened to break sheet ice which may be present at the mooring locations.

The mooring element 118 is provided with non-ballastable buoyancy chambers and water-ballastable buoyancy chambers. Preferably, the non-ballastable buoyancy chambers are sized such that when the ballastable buoyancy chambers are totally flooded, the mooring element 118 will descend to a submerged equilibrium position 15–25 meters beneath the ocean surface at which its buoyancy just equals the in-water weight of that portion of the mooring lines 120, riser 116 and other portions of the mooring system 114 supported at that depth. In this regard, the present embodiment of the invention functions in the same manner as that embodiment described previously.

The non-ballastable buoyancy chambers and water ballastable buoyancy chambers are symetrically arranged about the vertical axis of the mooring element 118 to ensure that the mooring element 118 remains substantially trim during all stages of flooding the ballastable buoyancy chambers. The mooring element 118 is provided with a ballast valve 177 (see FIG. 9) for flooding the ballastable buoyancy chambers. Deballasting is effected through an umbilical 179 which is attached by a diver to an umbilical coupling 181 located on the mooring element 118. Alternatively, the mooring element 118 can be provided with a remotely activated, releasable, surface recoverable deballasting umbilical.

This would avoid the need for divers in the mooring element recovery operation.

In docking with the mooring element 118, a service boat drops a diver near the mooring site. After attachment of the deballast umbilical 179, air is forced into the ballastable buoyancy tanks until the mooring element 118 rises to the ocean surface. Docking lines 178 are extended from towing clevises 180 on the mooring element 118 to deck winches 182 on the vessel 110. The deck winches 182 are then activated to tow the vessel 110 to the mooring element 118. As the mooring element 118 nears the vessel 110, the air pressure applied through the umbilical 179 is controlled to cause the mooring element 118 to assume the same draft as the vessel 110. The mooring element 118 is then pulled into the forward recess 134. The tapered interface between the mooring element 118 and the vessel 110 facilitates proper alignment. Rails 186 situated on the outer surface of the mooring element 118 and forward recess 184 serve as impact absorbing fenders to prevent damage to the vessel 110 and mooring element 118 in the course of docking. Steam jets can be used to free the interface between the mooring element 118 and vessel 110 of any ice which may be present.

Figure 10:
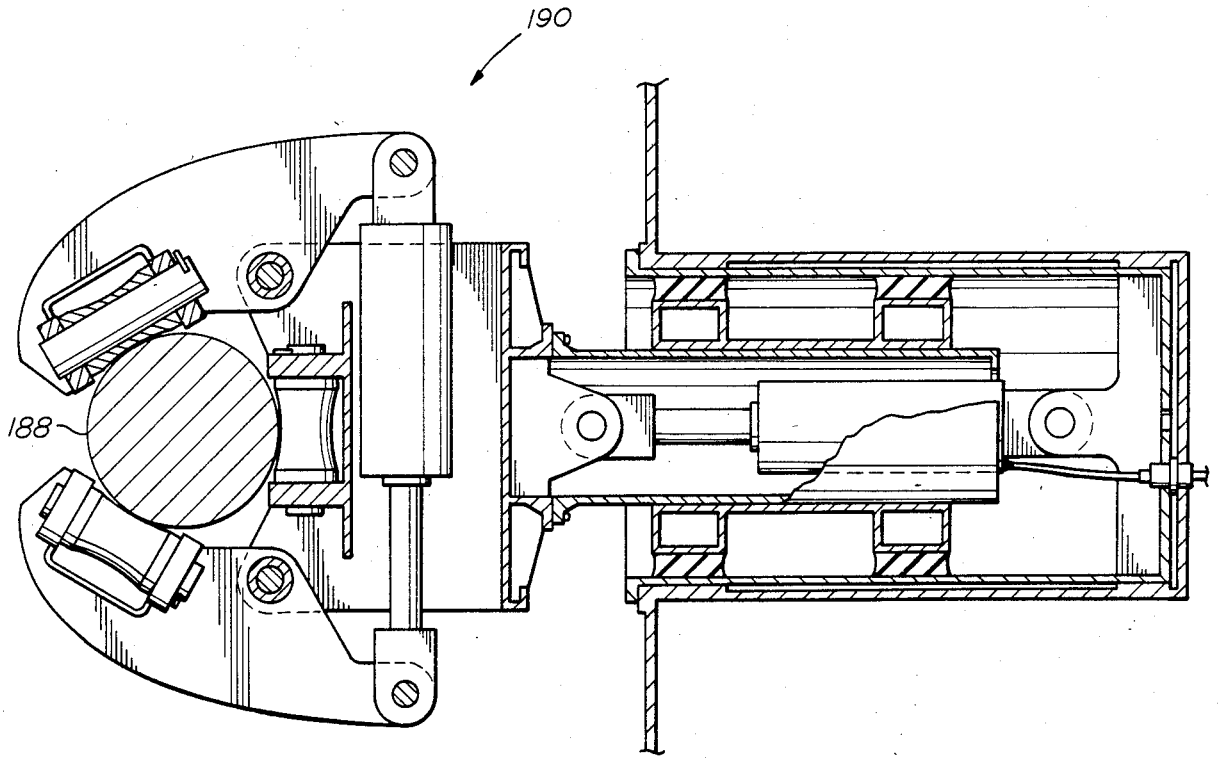

The mooring element 118 includes a vertical docking post 188 rigidly connected to the main body of the mooring element 118. The docking post 188 is spaced a radial distance outward from that portion of the mooring element main body which is received within the forward mooring recess 184. As the vessel 110 is winched to within a meter of its final position, hydraulic docking arms 190, best illustrated in FIG. 10, are activated to extend to and grasp the docking post 188. The docking arms 190 are then retracted, pulling the vessel 110 into final alignment with the mooring element 118. Following this, locking pins 192 are extended from housings in the walls of the forward mooring recess 184 into corresponding pin receiving ports 194 in the mooring element 118.

The mooring element 118 incorporates a turret 196 to which the fairleads 136 and riser 116 are secured. This permits the vessel 110 to weathervane in response to changing environmental conditions. Surrounding the turret 196 is a main body portion 197 of the mooring element 118 which is rotationally connected to the turret 196 by a bearing and race assembly (not shown). The riser 116 extends upward through the turret 196 to a fluid swivel 174 situated atop the mooring element 118. A lateral conduit 198 extends to a position proximate the top of the docking post 188 where it is provided with a coupling which is connected to the tanker onload flowline 200 upon docking of the vessel 110.

In releasing the vessel 110 from the mooring element 118, it is first necessary to ballast the ballastable mooring element buoyancy chambers to adjust the buoyancy of the mooring element 118 such that upon release it does not rise or fall relative to the vessel 110. This is necessary, of course, because the draft of the vessel 110 increases significantly in the course of hydrocarbon onloading. By properly adjusting the draft of the mooring element 118, relative vertical motion between the mooring element 118 and vessel 110 at the time of release is minimized. Following adjustment of the mooring element buoyancy, the docking arms 190 are extended. Next, the ballast valve 177 is opened and the docking arms 190 are opened, freeing the mooring element 118 which, after being fully ballasted, sinks to its equilibrium position. The vessel 110 is pulled away from the mooring element 118 at the time of release to minimize the chance of contract between the vessel 110 and mooring element 118.

The present invention and the best modes of practicing it have been described. It is to be understood that the forgoing descriptions are illustrative only and that other means and techniques can be employed without departing from the full scope of the invention as described in the appended claims.

What is claimed is:

1. A vessel having a detachable vessel mooring system, said vessel comprising:

a hull, said hull defining a mooring recess, said recess being situated intermediate the bow and stern of the vessel and being in a wholly submerged portion of said hull;

a buoyant mooring element sized to be situated within said submerged mooring recess;

a plurality of mooring lines extending between and connected to said mooring element and the ocean floor, said mooring lines being arranged so that as said mooring element moves downward from said mooring recess, an increasing amount of each mooring line comes to rest on the ocean floor;

means for securing said mooring element within said mooring recess;

means for permitting the vessel to pivot about the mooring element along a substantially vertical axis;

means for releasing said mooring element from said vessel; and, said mooring element being adapted to sink upon being released from said vessel to an equilibrium position above the ocean floor at which the buoyancy of the mooring element is balanced by the loading imposed on the mooring element, the loading on said mooring element decreasing with increasing depth due to increasing amounts of said mooring lines resting on the ocean floor.

2. The vessel as set forth in claim 1, wherein said vessel has a moonpool, the lower portion of said moonpool defining said mooring recess.

3. The vessel as set forth in claim 2, wherein the vessel includes a hoist, said hoist being adapted to lower a retrieval string through said moonpool, said hoist and retrieval string being adapted to secure the mooring element and hoist the mooring element into said mooring recess.

4. The vessel as set forth in claim 1, wherein said means for permitting the vessel to pivot is a turret within said mooring recess, and wherein said means for securing said mooring element within said mooring recess is means for locking said mooring element to said turret.

5. The vessel as set forth in claim 4, further including means situated on said vessel for grasping the mooring element when the mooring element is detached and submerged relative to the vessel, and for hoisting the mooring element into said submerged recess.

6. The vessel as set forth in claim 5, wherein said mooring element has an outer surface of generally frustoconical configuration with the taper of the frustoconical surface being oriented upwardly.

7. The vessel as set forth in claim 4, wherein said turret defines a support surface, and wherein said securing means includes a plurality of extensible support elements situated on said mooring element, said extensible support elements being adapted and positioned to be extended a horizontal distance outward from said mooring element to rest on said support surface.

8. The vessel as set forth in claim 4, wherein said mooring element defines a support surface, and wherein said securing means includes a plurality of extensible support elements situated on said turret, said extensible support elements being adapted and positioned to be extended a horizontal distance toward the axis of rotation of said turret, said support elements being adapted to support said mooring element at said support surface.

9. An oceangoing vessel and mooring system therefor, comprising:

a buoyant mooring element;

means for securing said vessel to said buoyant mooring element;

a plurality of mooring lines, one end of each mooring line being anchored to the ocean bottom and the other end being attached to said buoyant mooring element, the mooring lines being of a length sufficient that a portion of the mooring line nearest the ocean bottom rests on the ocean bottom when said mooring element is secured to said vessel, the amount of mooring line resting on the ocean bottom increasing as the distance from the ocean bottom to said mooring element is decreased;

means for allowing said vessel to pivot relative to at least a portion of said mooring element about a vertical axis;

means for selectively releasing said buoyant mooring element from said vessel, the buoyancy of said mooring element being less than the load imposed by said mooring system when said mooring element is secured within said vessel, whereby upon release said mooring element sinks under the loading of said mooring lines, said mooring element buoyancy being established such that an equilibrium position is reached above the ocean floor at which the buoyancy of said mooring element is balanced by the loading imposed on said mooring element at such equilibrium position.

10. The oceangoing vessel and mooring system as set forth in claim 9, wherein said vessel has a hull defining a moonpool, the lower portion of said moonpool defining a submerged recess in said hull, said recess being adapted to receive said mooring element.

11. The oceangoing vessel and mooring system as set forth in claim 10, wherein said means for allowing the vessel to pivot is a turret within said recess, said turret being attached to said vessel, and wherein said means for securing the vessel to the mooring element is means for locking said mooring element within said turret.

12. The oceangoing vessel and mooring system as set forth in claim 11, wherein the vessel further includes:

means for grasping said mooring element when the mooring element is submerged beneath said vessel; and, means for hoisting said mooring element into said turret.

13. The oceangoing vessel and mooring system as set forth in claim 10, wherein the outer surface of said mooring element is tapered upwardly.

14. The oceangoing vessel and mooring system as set forth in claim 13, wherein said mooring element is frustoconical.

15. The oceangoing vessel and mooring system as set forth in claim 12, wherein said mooring element is adapted to support the upper end of a production riser extending between said ocean floor and said mooring element, said vessel including fluid storage areas and a conduit and swivel assembly for transferring flow from said riser to said fluid storage areas.

16. The oceangoing vessel and mooring system as set forth in claim 9, wherein said vessel has a hull, said hull defining a recess situated in a wholly submerged portion of said hull intermediate the bow and stern of the vessel, said recess being adapted to receive said mooring element.

17. The oceangoing vessel and mooring system as set forth in claim 16, wherein said means for allowing the vessel to pivot is a turret attached to said vessel within said recess.

18. The oceangoing vessel and mooring system as set forth in claim 17, wherein said securing means includes a plurality of extensible support elements situated on said mooring element, said extensible support elements being adapted to be extended outward a horizontal distance from said mooring element.

19. The oceangoing vessel and mooring system as set forth in claim 18, wherein said turret defines a support surface atop of which said extensible support elements are adapted to rest.

20. The oceangoing vessel and mooring system as set forth in claim 19, wherein said turret and mooring element are configured such that said mooring element can be secured to said turret in any rotational orientation.

21. The oceangoing vessel and mooring system as set forth in claim 19, wherein said support surface is substantially circular, encircling said mooring element when said mooring element is secured within said recess.

22. The oceangoing vessel and mooring system as set forth in claim 17, wherein said securing means includes a plurality of extensible support elements situated on said turret, said extensible support elements being adapted to be extended inward a horizontal distance toward the rotational axis of said turret.

23. The oceangoing vessel and mooring system as set forth in claim 21, wherein said mooring element defines a support surface adapted to rest on said support elements.

24. The oceangoing vessel and mooring system as set forth in claim 23, wherein said turret and mooring element are configured such that said mooring element can be secured to said turret in any rotational orientation.

25. The oceangoing vessel and mooring system as set forth in claim 9, wherein said vessel includes a hull defining a mooring recess at a forward position thereon, said mooring recess being adapted to receive said mooring element, said mooring element serving as the vessel bow when secured within said mooring recess.

26. The oceangoing vessel and mooring system as set forth in claim 25, wherein said mooring element includes a main body portion and a turret, said mooring lines being attached to said turret and said main body portion being adapted to rotate relative to said turret about a substantially vertical axis, said vessel securing means being adapted to secure said vessel to said main body portion.

27. A mooring system for mooring a vessel, comprising:

a buoyant mooring element adapted to be secured within a recess in said vessel, said buoyant mooring element having an upper portion which is situated at an upper position on said mooring element when said buoyant mooring element being secured to the vessel;

means for releasing said mooring element from said vessel;

means for permitting said vessel to rotate about a vertical axis while maintaining at least a portion of said mooring element free from rotation;

a plurality of mooring lines, one end of each mooring line being anchored to the ocean floor and the other end being attached to said buoyant mooring element, a portion of each mooring line resting on the ocean bottom when the mooring element is secured to said vessel;

said mooring element being adapted, upon being released from said vessel, to sink to a predetermined depth above the ocean floor and to remain at that depth; and, means for ensuring that said mooring element upper portion remains uppermost, relative to said mooring element, while said mooring element is situated at said predetermined depth.

28. The vessel mooring system as set forth in claim 27, further including a riser extending between the ocean floor and said mooring element.

29. The vessel mooring system as set forth in claim 27, wherein said mooring element includes a connection member adapted to be grasped by a mooring element retrieval connector lowered from a hoist situated on said vessel.

30. The vessel mooring system as set forth in claim 29, wherein said mooring element upper portion defines a concave guide for said retrieval connector, said connection member being situated proximate a lower portion of said concave guide.

31. The vessel mooring system as set forth in claim 27, wherein said mooring element has fixed buoyancy sufficient to support a portion but not all of the load imposed on said mooring element by those portions of said vessel mooring system supported by said mooring element when said mooring element is secured to said vessel, whereby on release from said vessel said mooring element sinks, causing increasing amounts of said mooring lines to rest on said ocean floor, said mooring element being adapted to assume an equilibrium position a spaced distance above the ocean floor at which the buoyancy of said mooring element is balanced by the loading imposed on said mooring element by those portions of said vessel mooring system supported by said mooring element.

32. The vessel mooring system as set forth in claim 27, wherein said mooring element is provided with ballast tanks adapted to be controlled between a deballasted condition in which said mooring element has sufficient buoyancy to project above the ocean surface and a ballasted condition in which said mooring element sinks beneath the ocean surface to an equilibrium position above the ocean floor at which the buoyancy of said mooring element is balanced by the loading imposed on said mooring element, the loading on said mooring element decreasing with increasing depth due to increasing portions of said mooring system resting on the ocean floor.

33. A tanker vessel and system for maintaining said tanker vessel in fluid communication with a production riser, comprising:

a tanker hull, said hull defining a mooring recess;

a plurality of storage areas situated within said hull for receiving fluids;

a mooring element adapted to be received within said mooring recess;

means for securing said mooring element within said mooring recess;

means for permitting said vessel to rotate relative to said mooring element about a substantially vertical axis;

a riser of a length sufficient to extend from the ocean floor to said mooring element when said mooring element is positioned within said mooring recess, said riser being adapted to accomodate submergence of said mooring element a preselected distance beneath said mooring recess;

means for placing said riser in fluid communication with said tanker storage areas when said mooring element is secured within said mooring recess;

a plurality of mooring lines extending from the ocean floor to said mooring element, said mooring lines being adapted to bias said mooring element against substantial lateral motion, each of said mooring lines being adapted to have a lower portion thereof rest on the ocean floor, the amount of said line resting on said ocean floor increasing as said mooring element is submerged an increasing distance beneath said mooring recess;

means for releasing said mooring element from said vessel, said mooring element being adapted to submerge upon such release to a preselected depth intermediate the depth of said mooring recess and the depth of said ocean floor, said mooring element being adapted to remain at said preselected depth; and, means for causing said mooring element to rise from said preselected depth to the level of said mooring recess.

34. The tanker vessel as set forth in claim 33, wherein said mooring recess is situated at a forward position on said tanker vessel, said mooring element forming the bow of said tanker vessel in response to being secured within said mooring recess.

35. The tanker vessel as set forth in claim 34, wherein said mooring element is provided with ballast tanks adapted to be controlled between a deballasted condition in which said mooring element has sufficient buoyancy to project above the ocean surface and a ballasted condition in which said mooring element sinks beneath the ocean surface to an equilibrium position above the ocean floor at which the buoyancy of said mooring element is balanced by the loading imposed on said mooring element, the loading on said mooring element decreasing with increasing depth due to increasing portions of said mooring system resting on the ocean floor.

36. The tanker as set forth in claim 35, wherein that portion of the mooring element forming the bow of the vessel is adapted to break sheet ice impinging on said vessel.

* * * * *